US011340535B1

(12) United States Patent
Biegelsen et al.

(10) Patent No.: US 11,340,535 B1
(45) Date of Patent: May 24, 2022

(54) FOUNTAIN JET IMAGE FORMATION ON CHARGED IMAGE SURFACE

(71) Applicant: Palo Alto Research Center Incorporated, Palo Alto, CA (US)

(72) Inventors: David K. Biegelsen, Portola Valley, CA (US); JengPing Lu, Fremont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 17/201,583

(22) Filed: Mar. 15, 2021

(51) Int. Cl.
*G03G 15/10* (2006.01)
*G03G 15/02* (2006.01)

(52) U.S. Cl.
CPC ..... *G03G 15/0291* (2013.01); *G03G 15/10* (2013.01)

(58) Field of Classification Search
CPC ..... G03G 15/10; G03G 15/108
USPC ..... 399/237, 247, 248
See application file for complete search history.

(56) References Cited

U.S. PATENT DOCUMENTS 4,289,092 A * 9/1981 McChesney et al. . G03G 15/11 399/247
7,136,612 B2 11/2006 Nooyens et al.
8,126,367 B2 2/2012 Fowler
8,586,277 B1 11/2013 Veres et al.
8,824,941 B2 9/2014 Shimizu et al.
8,995,015 B2 3/2015 Schulmeister
9,388,319 B2 7/2016 Mayo et al.
2018/0051183 A1 2/2018 Allen et al.
2019/0270897 A1 9/2019 Allen et al.
2020/0353770 A1 11/2020 Sambhy et al.

FOREIGN PATENT DOCUMENTS

EP 3354476 A1 4/2015
EP 2447066 B1 5/2015
EP 3078499 B1 9/2018

* cited by examiner

*Primary Examiner* — William J Royer
(74) *Attorney, Agent, or Firm* — Ortiz & Lopez, PLLC; Kermit D. Lopez; Luis M. Ortiz

(57) ABSTRACT

A system and method for creating a fountain solution pattern for digital imaging, can include a charge image bearing surface bearing a charge image, an array of insulated channels, wherein a fountain solution can enter and fills the array of insulated channels by capillary action to a ledge region of the insulated channels in the array of insulated channels, and a scorotron that charges a surface of the fountain solution in the array of insulated channels. The array of insulated channels can be moved into proximity with the charge image on the charge image bearing surface of a digital printer, such that a fountain solution pattern can be developed on the charge image bearing surface with a measured amount of the fountain solution.

20 Claims, 9 Drawing Sheets

FOUNTAIN JET IMAGE FORMATION ON CHARGED IMAGE SURFACE

TECHNICAL FIELD

Embodiments relate to digital printing systems and in particular, to digital architecture for lithographic inks (DALI) printing systems. Embodiments further relate to techniques for creating a fountain solution image for subsequent transfer to a DALI blanket in a DALI printing system.

BACKGROUND

Ink-based digital printing uses a variable data lithography printing system, examples of which include digital offset printing and Digital Architecture for Lithographic Inks (DALI) printing. A "variable data lithography system" relates to a system that can be configured for lithographic printing using lithographic inks and based on digital image data, which may be variable from one image to the next. "Variable data lithography printing," or "digital ink-based printing," or "digital offset printing," or DALI involves lithographic printing of variable image data for producing images on a media substrate that may be changeable with each subsequent rendering of an image on the media substrate in an image forming process.

DALI printing systems include "variable data lithography systems" that can be configured for lithographic printing using lithographic inks and based on digital image data, which may be variable from one image to the next. "Variable data lithography printing," or "digital ink-based printing," or "digital offset printing," or DALI involve lithographic printing of variable image data for producing images on a media substrate that are changeable with each subsequent rendering of an image on the media substrate in an image forming process.

One example of a DALI system is disclosed U.S. Patent Application Publication No. 20190270897 entitled "Digital Offset Lithography Ink Composition," which published on Sep. 5, 2019 and is incorporated herein by reference in its entirety. U.S. Patent Application Publication No. 20190270897 is assigned to the Xerox Corporation and illustrates an example of an ink-based variable image digital printing system.

In DALI offset lithographic printing processes, planographic plates can be used to transfer ink to a blanket roll (also referred to as a 'blanket'), which, in turn, can then transfer the ink to a substrate thereby forming printed images. The plates may be referred to as 'planographic' since the image and non-image areas are in the same plane. The plates can be configured so that with proper treatment the image areas are hydrophobic and oleophilic and thereby receptive to inks. The non-image areas are hydrophilic and are water receptive. In order to maintain the hydrophilic characteristics on the non-image areas, so as to prevent ink from accumulating on these areas, it may be necessary continuously to treat the plate with a water based fountain solution.

While an offset printing press is running, a fountain solution can be applied continuously to the printing plate just before the application of the printing ink. The fountain solution has an affinity for the non-image (hydrophilic) areas of the plate and wets these areas. A complete and uniform film of fountain solution on the non-image areas may prevent the subsequent application of ink from covering the plate on the non-image areas. The fountain solution and ink on the plate are then both transferred to the blanket and then to the substrate. The process can be then repeated.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved digital printing apparatus, system, and method of use.

It is another aspect of the disclosed embodiments to provide for an improved DALI printing system.

It is also an aspect of the disclosed embodiments to provide methods and systems for creating a fountain solution image for subsequent transfer to a DALI blanket in a DALI printing system.

The aforementioned aspects and other objectives and advantages can now be achieved as described herein. In an embodiment, a system for creating a fountain solution pattern for digital imaging, can include: a charge image bearing surface bearing a charge image, an array of insulated channels, wherein a fountain solution can enter and fills the array of insulated channels by capillary action to a ledge region of the insulated channels in the array of insulated channels, and a scorotron that charges a surface of the fountain solution in the array of insulated channels. The array of insulated channels can be moved into proximity with the charge image on the charge image bearing surface of a digital printer, such that a fountain solution pattern can be developed on the charge image bearing surface with a measured amount of the fountain solution.

In an embodiment of the system, the fountain solution pattern developed on the charge image bearing surface can comprise a fountain solution image that can be subsequently transferrable to a blanket (e.g., such as an imaging blanket).

In an embodiment of the system, the blanket can comprise an optically absorbing blanket.

In an embodiment of the system, the array of insulated channels can comprise a two-dimensional array of the insulated channels.

In an embodiment of the system, the array of insulated channels can comprise an electrically insulated matrix.

In an embodiment of the system, the array of insulated channels can comprise a capillary matrix.

In an embodiment of the system, the array of insulated channels can be configured from at least: a resist double layer with a UV-opaque interlayer.

In an embodiment of the system, the array of insulated channels can be further configured from a release layer and a UV-transparent support plate.

In an embodiment, a method for creating a fountain solution pattern for digital imaging, can involve: providing an array of insulated channels and a charge image bearing surface bearing a charge image, wherein a fountain solution enters and fills the array of insulated channels by capillary action to a ledge region of insulated channels in the array of insulated channels; charging with a scorotron, a surface of the fountain solution in the array of insulated channels; moving the array of insulated channels into proximity with the charge image on the charge image bearing surface of a digital printer; and developing a fountain solution pattern on the charge image bearing surface with a measured amount of the fountain solution.

In an embodiment of the method, the fountain solution pattern developed on the charge image bearing surface can comprise a fountain solution image that can be subsequently transferrable to a blanket.

In an embodiment of the method, the blanket can comprise an optically absorbing blanket.

In an embodiment of the method, the array of insulated channels can comprise a two-dimensional array of the insulated channels.

In an embodiment of the method, the array of insulated channels can comprise an electrically insulated matrix.

In an embodiment of the method, the array of insulated channels can comprise a capillary matrix.

In an embodiment of the method, the array of insulated channels can be configured from at least a resist double layer with a UV-opaque interlayer.

In an embodiment of the method, the array of insulated channels can be further configured from a release layer and a UV-transparent support plate.

In an embodiment, a system for creating a fountain solution pattern for digital imaging, can include at least one processor and a memory, the memory storing instructions to cause the at least one processor to perform: charging with a scorotron, a surface of a fountain solution in an array of insulated channels wherein the fountain solution enters and fills the array of insulated channels by capillary action to a ledge region of the insulated channels in the array of insulated channels; and moving the array of insulated channels into proximity with a charge image on a charge image bearing surface of a digital printer, wherein a fountain solution pattern is developed on the charge image bearing surface with a measured amount of the fountain solution.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the embodiments.

DETAILED DESCRIPTION

Figure 1:
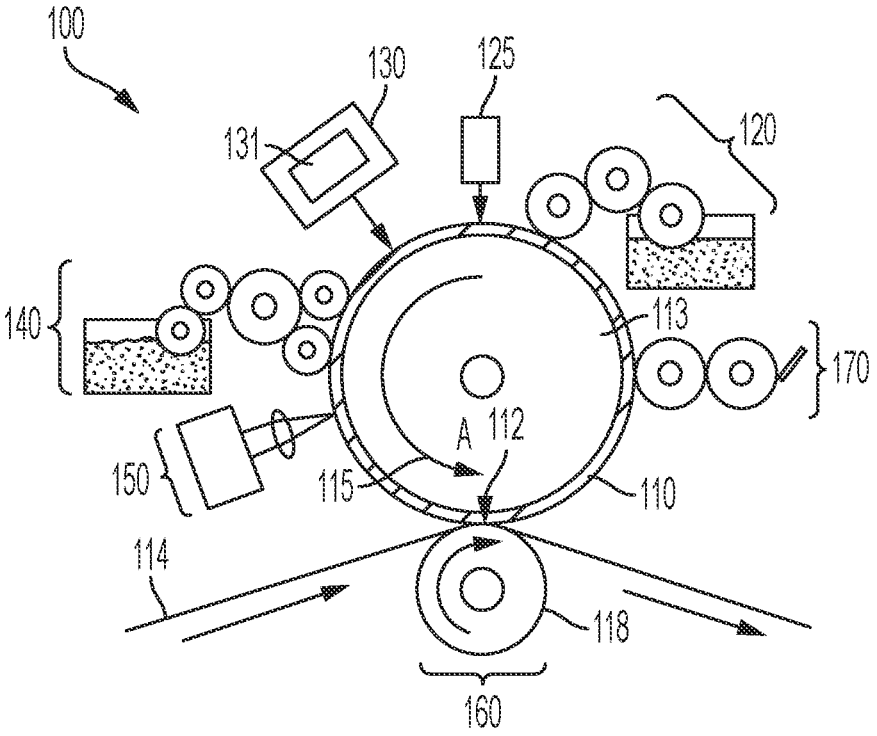
FIG. 1 illustrates a schematic of a digital printing system that can be adapted for use with an embodiment.

The particular values and configurations discussed in these non-limiting examples can be varied and are cited merely to illustrate one or more embodiments and are not intended to limit the scope thereof. Exemplary embodiments are intended to cover all alternatives, modifications, and equivalents as may be included within the spirit and scope of the composition, apparatus and systems as described herein.

A more complete understanding of the processes, systems and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof. In the drawing, like reference numerals may be used throughout to designate similar or identical elements.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity may be inclusive of the stated value and can have a meaning dictated by the context (for example, it may include at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Although embodiments are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather can be used to distinguish one element from another. The terms "a" and "an" herein may not denote a limitation of quantity, but rather can denote the presence of at least one of the referenced item.

The term "printing device", "printing system", or "digital printing system" as used herein can refer to a digital copier or printer, scanner, image printing machine, digital production press, document processing system, image reproduction machine, bookmaking machine, facsimile machine, multifunction machine, or the like and can include several marking engines, feed mechanism, scanning assembly as well as other print media processing units, such as paper feeders, finishers, and the like. The digital printing system can handle sheets, webs, marking materials, and the like. A digital printing system can place marks on any surface, and the like and is any machine that can read marks on input sheets; or any combination of such machines.

The term "printing device", "printing system", or "digital printing system" and variations thereof as used herein may refer to devices and systems based on ink printing or which can provide imaged liquid layers for applications other than ink printing, such as, for example, three-dimensional (3D) layer-by-layer construction using ultraviolet (UV) curable liquids.

The term 'fountain solution' as utilized herein generally refers to a material, which can adhere to a substrate and may split in an inking nip to reject ink from adhering to the substrate. In some situations the fountain solution can adhere to a substrate and bind ink, which does not otherwise adhere to the substrate. Below we will speak of the former use, however it should be read as applying in either modality. The fluid (i.e., liquid, solution, etc) referred to herein can be a water or aqueous-based fountain solution which can be applied in an airborne state such as by vapor or by direct contact with a wetted imaging member through a series of rollers for uniformly wetting a member with the fluid. The solution or fluid can be non-aqueous composed of, for example, silicone fluids (e.g., such as D3, D4, D5, OS10, OS20, OS30 and the like), Isopar fluids, and polyfluorinated ether or fluorinated silicone fluid.

Note that the term 'fountain solution' as utilized herein is not limited to the aforementioned splitting feature. That is, a 'fountain solution' can include, for example, a thin fountain solution that does not split, but which can adhere to the ink and may be removed from the substrate in its entirety. Thus, a fountain solution may include situations involving a non-splitting, complete removal of the fountain solution by ink. Furthermore, the fountain solution may only partially or may not at all adhere to the ink, thereby still rejecting the transfer of ink to the substrate. In this case, removal of the fountain solution after the inking nip may be required.

FIG. 1 illustrates a schematic diagram of a digital printing system 100 that can be adapted for use with an embodiment. As depicted in FIG. 1, the exemplary digital printing system 100 may include an imaging member 110. The digital printing system 100 can be implemented as a system for variable lithography. In a preferred embodiment, the digital printing system 100 may be configured to operate as a DALI printing system.

Note that the acronym 'DALI' refers to the term 'Digital Architecture for Lithographic Inks'. DALI has in some instances also been referred to as 'Digital Advanced Lithographic Imaging'. Thus, the terms 'Digital Advanced Lithographic Imaging' and 'Digital Architecture for Lithographic Inks' can be utilized interchangeably to refer to the same general type of DALI printing system, DALI printing device or DALI printing method.

The imaging member 110 in the embodiment shown in FIG. 1 may be a drum, but this exemplary depiction should not be interpreted so as to exclude embodiments wherein the imaging member 110 includes a drum, plate or a belt, or another now known or later developed configuration. The reimageable surface may be formed of materials including, for example, a class of materials commonly referred to as silicones, including polydimethylsiloxane (PDMS), among others. For example, silicone, fluorosilicone, and/or VITON may be used. The reimageable surface may be formed of a relatively thin layer over a mounting layer, a thickness of the relatively thin layer being selected to balance printing or marking performance, durability and manufacturability.

The imaging member 110 can be used to apply an ink image to an image receiving media substrate 114 at a transfer nip 112. The transfer nip 112 can be formed by an impression roller 118, as part of an image transfer mechanism 160, exerting pressure in the direction of the imaging member 110. Image receiving media substrate 114 should not be considered to be limited to any particular composition such as, for example, paper, plastic, or composite sheet film. The exemplary system 100 may be used for producing images on a wide variety of image receiving media substrates.

There can be wide latitude of marking (printing) materials that may be used, including marking materials with pigment loading greater than 10% by weight. This disclosure will use the term 'ink' to refer to a broad range of printing or marking materials to include those, which are commonly understood to be inks, pigments, and other materials, which may be applied by the exemplary system 100 to produce an output image on the image receiving media substrate 114. Note that the terms 'image" and 'imaging' as utilized herein can relate to a two-dimensional distribution of adjacent pixel with differing properties (e.g., temperature).

The imaging member 110 including the imaging member 110 may comprise a reimageable surface layer formed over a structural mounting layer that may be, for example, a cylindrical core, or one or more structural layers over a cylindrical core.

The exemplary system 100 may include a dampening fluid system 120 generally comprising a series of rollers, which may be considered as dampening rollers or a dampening unit, for uniformly wetting the reimageable surface of the imaging member 110 with dampening fluid. A purpose of the dampening fluid system 120 is to deliver a layer of dampening fluid, generally having a uniform and controlled thickness, to the reimageable surface of the imaging member 110. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Exemplary dampening fluids include water, NOVEC® 7600 (1,1,1,2,3,3-Hexafluoro-4-(1,1,2,3,3,3-hexafluoropropoxy)pentane and has CAS #870778-34-0), and D4 (octamethylcyclotetrasiloxane). It should be appreciated that these dampening fluids are mentioned in this discussion for illustrative and exemplary purposes only and are not considered limiting features of the embodiments.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid system 120.

After a precise and uniform amount of dampening fluid is provided by the dampening fluid system 120 on the reimageable surface of the imaging member 110, an optical patterning subsystem 130 may be used to selectively form a latent image in the uniform dampening fluid layer by imagewise patterning the dampening fluid layer using, for example, laser energy. Typically, the dampening fluid may not absorb the optical energy (IR or visible) efficiently. The optical patterning subsystem 130 can be implemented as or may include a light source 131 (e.g., a vertical cavity surface emitting (VCSEL) array, a light emitting diode (LED) array, a laser light source that emits the pixilated light beam as a pixelated line laser beam, or a modulated laser line source).

The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being or including a light source such as a laser emitter, it should be understood that a variety of different systems may be used to deliver the optical energy to pattern the dampening fluid.

The mechanics at work in the patterning process undertaken by the optical patterning subsystem 130 of the exemplary system 100 are known to those in the art. Briefly, the application of optical patterning energy from the optical patterning subsystem 130 can result in selective removal of portions of the layer of dampening fluid.

Following patterning of the dampening fluid layer by the optical patterning subsystem 130, the patterned layer over the reimageable surface of the imaging member 110 can be presented to an inker subsystem 140. The inker subsystem 140 can be used to apply a uniform layer of ink over the layer of dampening fluid and the reimageable surface layer of the imaging member 110. The inker subsystem 140 can further include heated ink baths whose temperatures can be regulated by a temperature control module (not shown in FIG. 1). The inker subsystem 140 may use an anilox roller to meter an offset lithographic ink onto one or more ink forming rollers that can be in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism, for example, may involve the use of a rheology (complex viscoelastic modulus) control subsystem 150. The rheology control subsystem 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink can be then transferred from the reimageable surface of the imaging member 110 to a substrate of image receiving media substrate 114 using the image transfer mechanism 160. The transfer occurs as the substrate 114 is passed through the transfer nip 112 between the imaging member 110 and the impression roller 118 such that the ink within the voids of the reimageable surface of the imaging member 110 is brought into physical contact with the substrate 114. With the adhesion of the ink having been modified by the rheology control subsystem 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller (not shown in FIG. 1) may first receive the ink image pattern and then transfer the ink image pattern to a substrate according to a known indirect transfer method. Following the transfer of the majority of the ink to the substrate 114, any residual ink and/or residual dampening fluid must be removed from the reimageable surface of the imaging member 110, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 170. The cleaning subsystem 170 comprises at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

Other mechanisms by which cleaning of the reimageable surface of the imaging member 110 may be facilitated. Regardless of the cleaning mechanism, however, cleaning of the residual ink and dampening fluid from the reimageable surface of the imaging member 110 can be essential to preventing ghosting in the proposed system. Once cleaned, the reimageable surface of the imaging member 110 can be again presented to the dampening fluid system 120 by which a fresh layer of dampening fluid can be supplied to the reimageable surface of the imaging member 110, and the process can be repeated.

As discussed above, digital offset ink must possess physical and chemical properties that are specific to ink-based digital printing systems. The ink must be compatible with materials that it comes in contact with, including the imaging plate and dampening fluid, and printable substrates such as paper, metal, or plastic. The ink must also meet all functional requirements of the subsystems including wetting and transfer properties defined by subsystem architecture and material sets.

Inks formulated for ink-based digital printing, or digital offset inks, are different in many ways from other inks developed for printing applications, including pigmented solvents, UV gel inks, and other inks. For example, digital offset inks contain much higher pigment and therefore have higher viscosity at room temperature than other inks, which can make ink delivery by way of an anilox roll or inkjet system difficult. Digital offset inks must meet certain wetting and release property requirements imposed by the imaging member used for ink-based digital printing processes, while being compatible with non-aqueous dampening fluid options. Digital offset ink should not cause the imaging member surface to swell. Water-dilutable and water-diluted inks in accordance with embodiments include digital offset acrylate inks meeting such requirements.

Digital offset inks in accordance with water-dilutable ink embodiments advantageously have a much lower solubility in dampening fluid such as D4 than related art inks. Also, digital offset inks do not tend to swell a silicone-containing imaging member surface layer used in ink-based digital printing systems such as that shown in FIG. 1, which may be a silicone, fluorosilicone, or VITON-containing imaging plate or blanket.

Note that the term 'blanket' as utilized herein may also refer to a printing blanket, an ink blanket or an inking blanket. In FIG. 1, a blanket 113 (i.e., an imaging cylinder blanket) is shown, which is surrounded by a printing plate 110. That is, the printing plate 110 can surround the cylindrically shaped blanket 113. The blanket 113 with the printing plate 110 can rotate in the direction indicated by the curved arrow 115.

Figure 2:
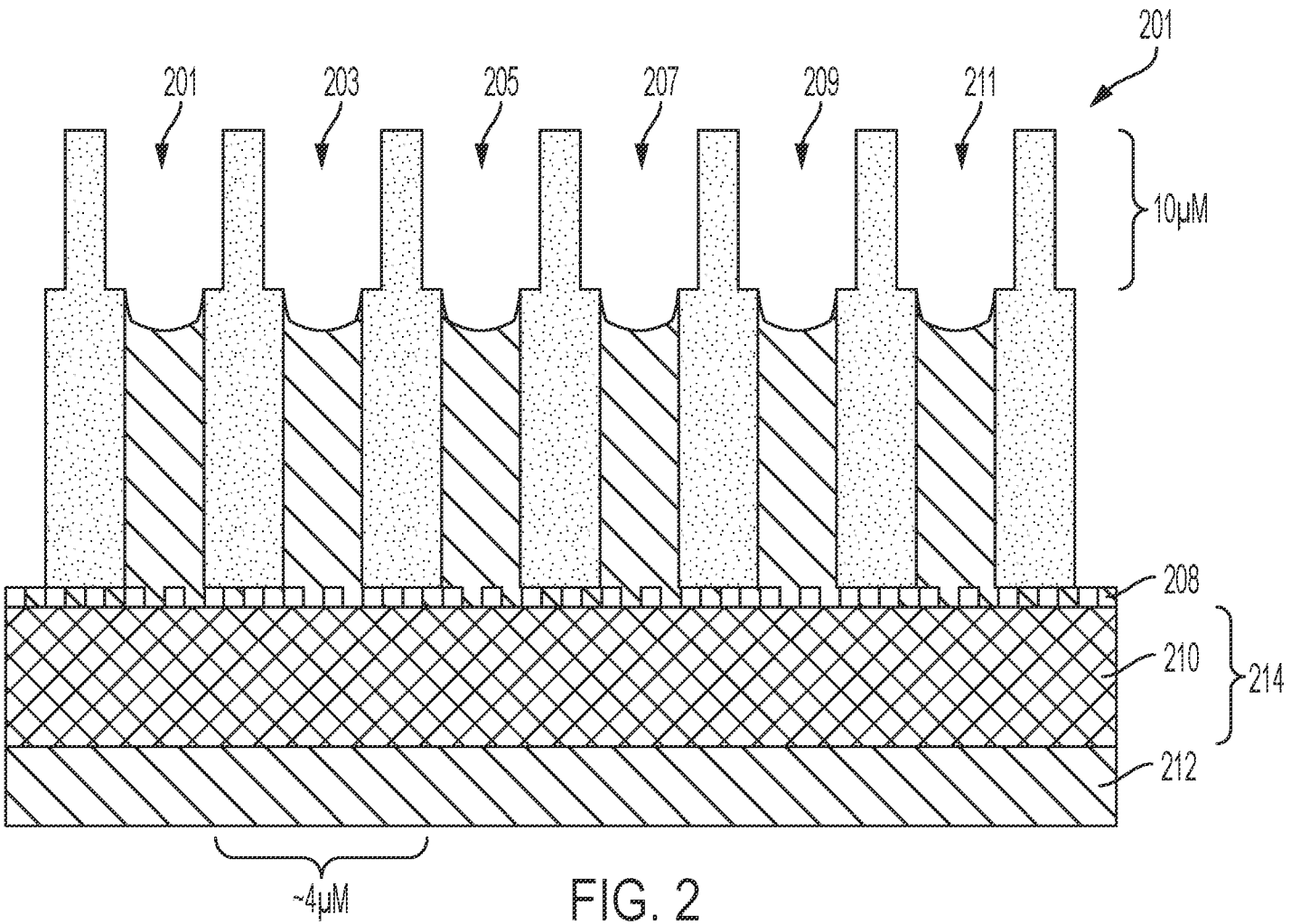
FIG. 2 illustrates a side sectional view of an array of insulated channels that can be used with a system for creating a fountain solution pattern for digital imaging, in accordance with an embodiment.

FIG. 2 illustrates a side sectional view of an array 201 of insulated channels that can be used with a system for creating a fountain solution pattern for digital imaging, in accordance with an embodiment. The array 201 can be configured as a matrix or array of insulated channels 201, 203, 205, 207, 209 and 211 associated with a charge image bearing surface (CIBS) (not shown in FIG. 2), wherein a fountain solution can fill the array 201 of insulated channels 201, 203, 205, 207, 209 and 211 by capillary action to a ledge region of the array 201. An example of a CIBS is shown as CIBS 204 in FIG. 4. FIG. 2 to FIG. 9 disclosed herein disclose varying embodiments for creating a fountain solution (FS) image for subsequent transfer to a DALI blanket such as the blanket 113 shown in FIG. 1. Note that as utilized herein the terms 'matrix' and 'array' may be utilized interchangeably to refer to the same feature.

One embodiment for the FS development of a charge image on a CIBS can use an array of channels such as the array 201 through an electrically insulating matrix, such as SU-8, fluorinated silicone, etc. The array 201 of channels 201, 203, 205, 207, 209 and 211 can be configured with a capillary structure. As shown FIG. 2, the bottom side of the matrix can be in contact with a pool 212 of FS via a porous supporting structure 214 including a porous metal plate (or porous metal drum) 210 disposed below or proximate to a porous laminate 208. The porous supporting structure 214 can include the porous metal plate 210 and optionally, the porous laminate 208. The porous metal plate 210 can be optionally covered by a thin film (e.g., the porous laminate 208) having finer holes spaced more closely than the pores in the porous supporting structure 214.

In an alternative embodiment, the bottom of the capillary structure of the array 201 can be metalized and can act as a field electrode. FS can be drawn by capillary action from the pool 212 to the topside of the channels 201, 203, 205, 207, 209 and 211. A meniscus can be pinned at the abrupt openings of each of the channels 201, 203, 205, 207, 209 and 211. Note that in some embodiments, the top portion of each channel can have a dimension of about 10 μm and the length of a channel may be about 4 μm. It should be appreciated that these dimensions and other example parameters illustrated and discussed herein are not to be considered limiting features of the embodiments, but are presented herein for generally illustrative and exemplary purposes only. Furthermore, it should be appreciated that additional channels may be implemented with the array 201. That is, although channels 201, 203, 205, 207, 209 and 211 are depicted in FIG. 2, additional channels may be configured with the array 201.

Figure 3:
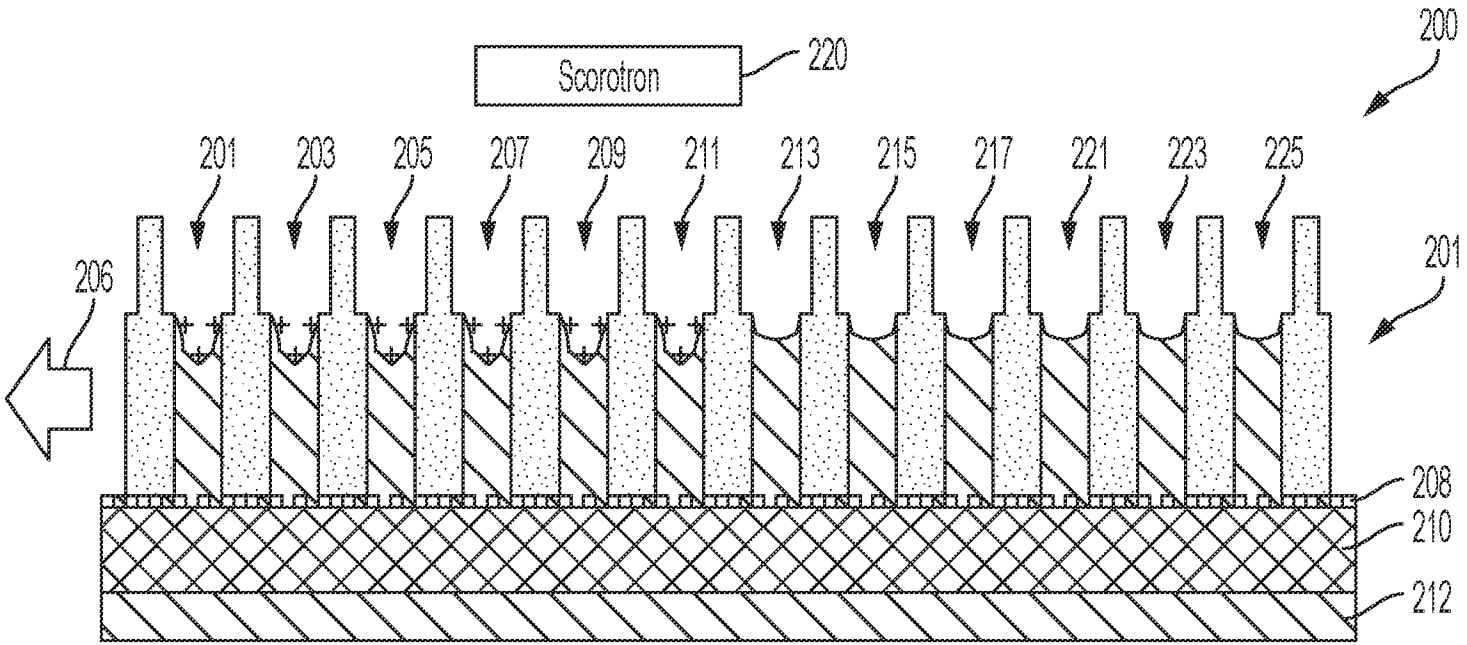
FIG. 3 illustrates a side sectional view of a system for creating a fountain solution pattern for digital imaging, which includes the array of insulated channels depicted in FIG. 2, in accordance with an embodiment.

FIG. 3 illustrates a side sectional view of a system 200 for creating a fountain solution pattern for digital imaging, which can include the array 201 depicted in FIG. 2, in accordance with an embodiment. Note that in addition to the channels 201, 203, 205, 207, 209 and 211, which are illustrated in FIG. 2, the array 201 can include additional channels such as, for example channels 213, 215, 217, 221, 223 and 225.

Figure 4:
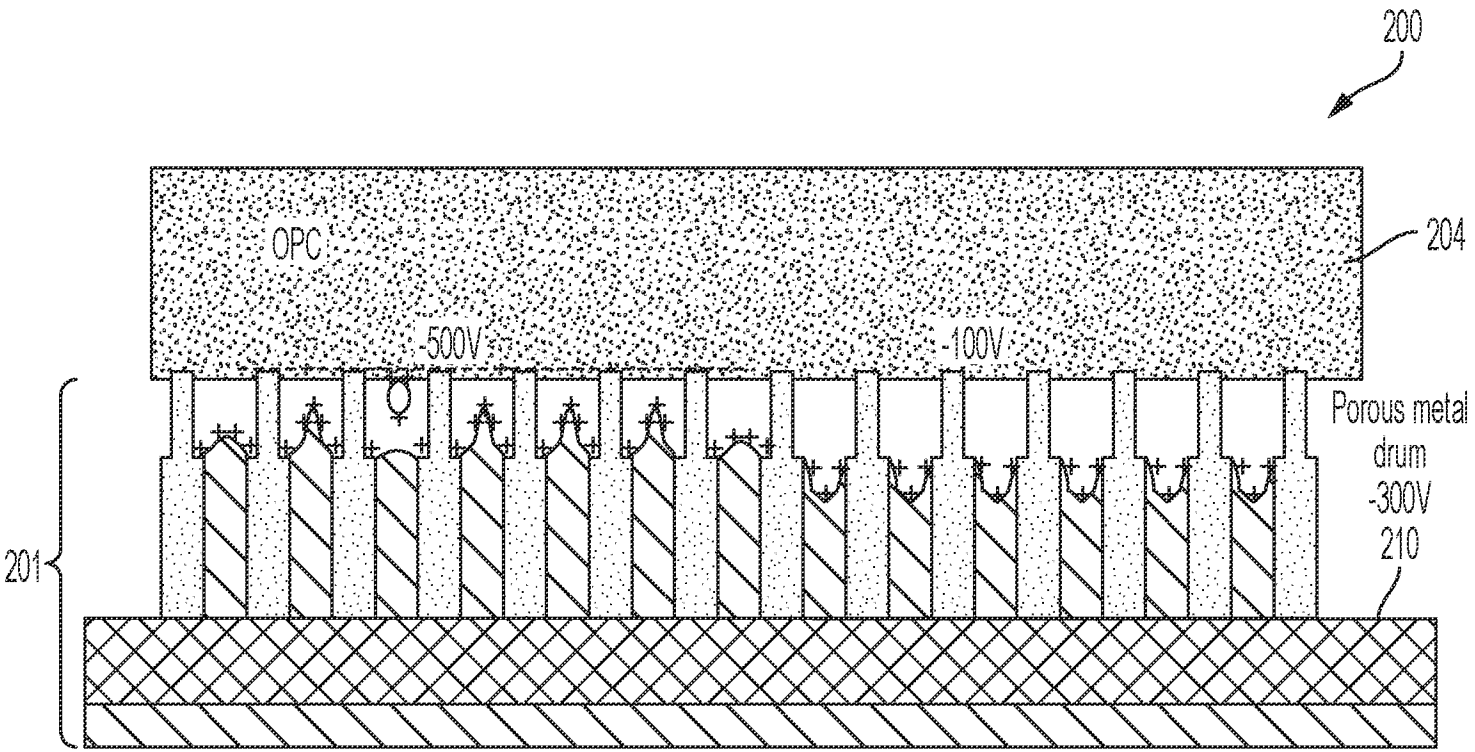
FIG. 4 illustrates a side sectional view of the system for creating a fountain solution pattern for digital imaging with respect to a charge image bearing surface, in accordance with an embodiment.

As discussed above, the array 201 of channels can be associated with a CIBS (e.g., CIBS 204 shown in FIG. 4).

Fountain solution can enter and fill the array 201 by capillary action to a ledge region of the CIBS.

The system 200 can include a scorotron 220 that can create a charged image on the CIBS. The array 201 of channels can be moved into proximity with a blanket (e.g., the blanket 113 of the digital printing system 100 shown in FIG. 1) and biased with an electric charge, such that a fountain solution pattern can be developed on the CIBS with a measured amount of the fountain solution brought into proximity to the CIBS. Thus, FIG. 3 depicts the top surface of the electrically insulating FS charged as the matrix/array 201 passes below the scorotron 220 in the direction of the arrow 206.

Note that the term 'scorotron' as utilized herein relates to a device, which can create a corona discharge current. A scorotron can also be referred to as a corona grid. The scorotron can charge a surface of the fountain solution in the array 201.

FIG. 4 illustrates a side sectional view of the system 200 with respect to the CIBS 204, in accordance with an embodiment. The array 201 of channels can comprise or function as a capillary matrix, and can be mounted either on a cylindrical drum, plate or seamless belt. This capillary matrix can be brought into physical contact with, or close proximity to the CIBS 204, as shown in FIG. 4. The back side of the capillary matrix (i.e., the array 201) can be set to a voltage equal to the mean value between the charged and discharged states of the CIBS 204.

When brought into close proximity with the surface of the CIBS 204, charge in the electric field forces the meniscus away from the CIBS 204 below the discharged pixels. In proximity to charged pixels, however, the field can include a runaway deformation of the liquid meniscus towards the CIBS 204 and a jet can be formed. The jet necks off, depositing a single drop of fountain solution. The charge transferred with the droplet tends to locally discharge the electrostatic image on the CIBS 204 as well as the fixed charge in the jet channel. The electric field between the net charge remaining on the CIBS 204 and the charge remaining on the capillary fluid can be below a threshold for further jet formation.

By setting the grid voltage of the scorotron 220, the charge density (voltage) on the CIBS 204 can be adjusted to control the amount of fountain solution transferred—depending, for example, on the print speed. (The photoreceptor can be cooled to reduce fountain solution spreading. For D4 chilling the photoreceptor below 17 C can cause the fountain solution to freeze after deposition.) After the FS image has been developed on the CIBS 204, the CIBS 204 can be brought into contact with, for example, the DALI blanket 113 in a FS transfer nip. There, the fountain solution can split/transfer to supply the blanket 113 with the desired pixelated fountain solution coverage. Note that voltage values such as +500V and −100V and the voltage value −300V (with respect to the porous metal plate 210) depicted in FIG. 4 are shown for exemplary and illustrative purposes and are not considering limiting features of the disclosed embodiments.

There are various methods for fabrication of the capillary matrix. One approach can use casting of a silicone fluid on a metal or silicon mold having an array of pins with the inverse shape of the desired matrix features. The silicone can be cured and peeled from mold and wrapped/bonded onto the metal support.

Figure 5:
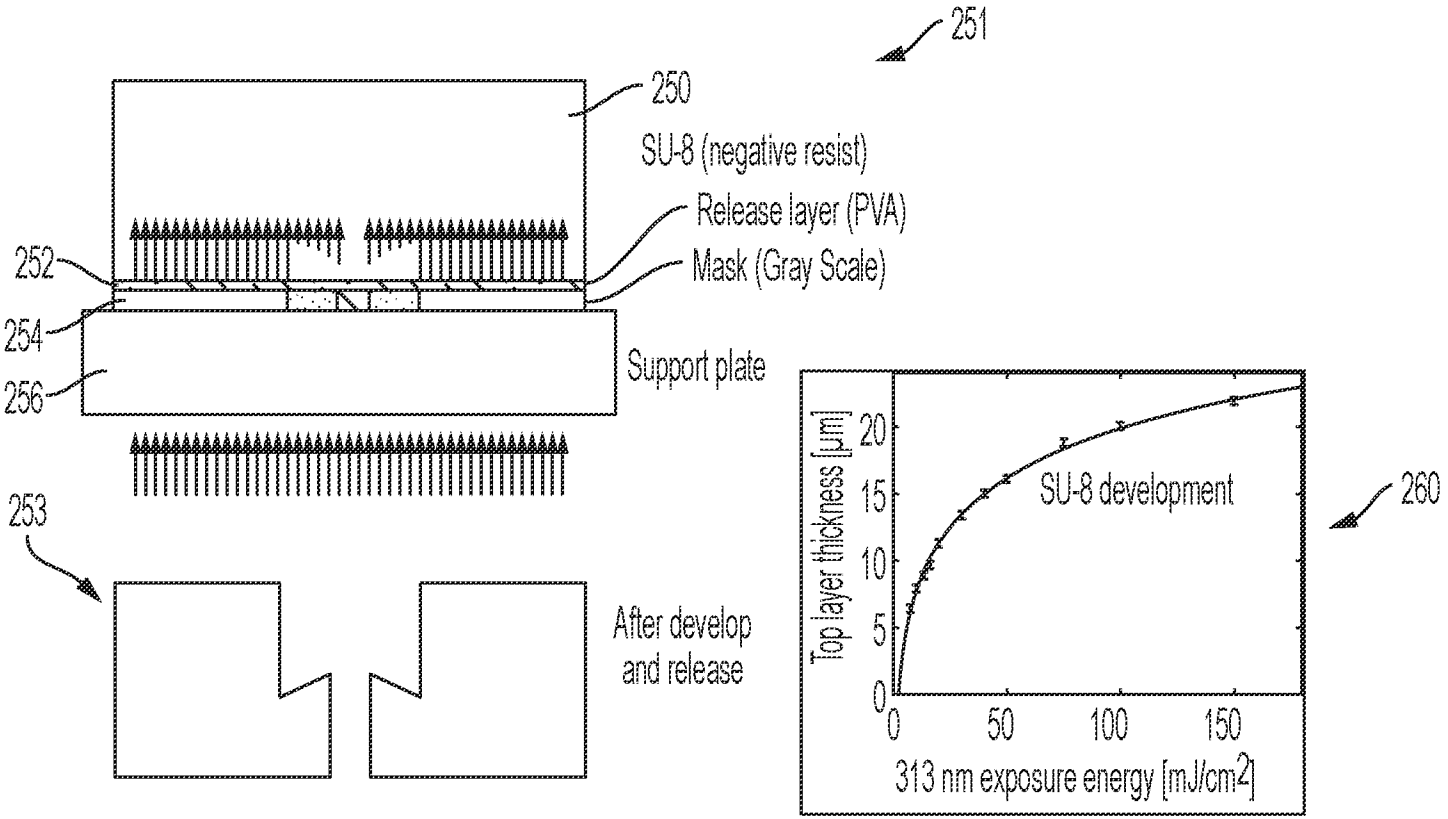
FIG. 5 illustrates a method for fabricating the array of insulated channels, in accordance with an alternative embodiment.

A second approach can use a grayscale mask to expose a thick layer of a photo-developable polymer such as SU-8. FIG. 5 illustrates this second fabrication approach, in accordance with an alternative embodiment. That is, a thick layer 250 of SU-8 can be coated (by spinning or other means) onto a photo-mask plate pre-coated with a release layer such as PVA 252.

As shown in an upper portion 251 of FIG. 5, a gray scale mask 254 can shape the intensity of the exposure level of the SU-8. (A graph 260 indicates the SU-8 development as a function of exposure level.) After development and removal from a mask plate 256, by dissolving the PVA in water, the developed SU-8 can produce, as shown in a lower portion 253 of FIG. 5, the re-entrant shaped via due to the corresponding UV energy deposition. (Note that in FIG. 5, the figure is inverted from where it was depicted in the upper portion of the figure.) The angle of the mid-level surface is useful for enhancing the meniscus pinning of the FS.

Figure 6:
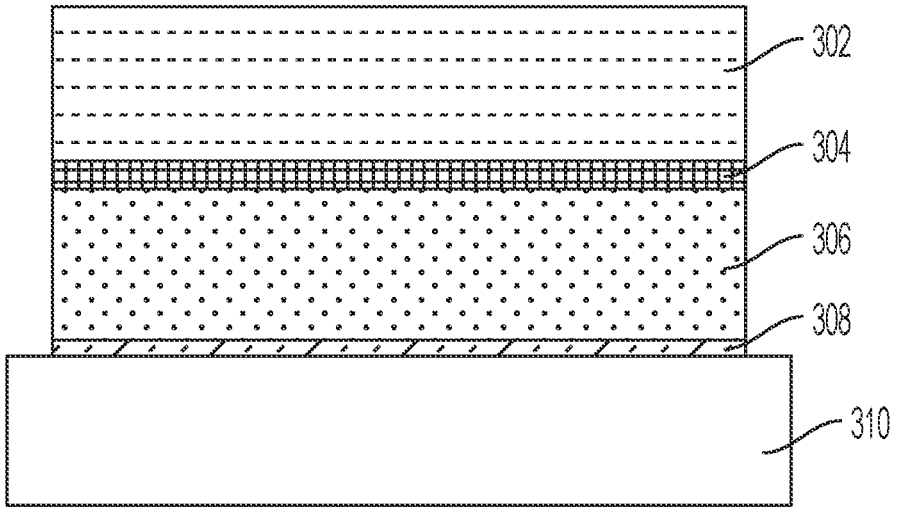
FIG. 6 illustrates a first step of a method for fabricating the array of insulated channels which utilizes a resist double layer with a UV-opaque interlayer, in accordance with another embodiment.

FIG. 6 illustrates a first step of a method for fabricating an array of insulated channels such as the array 201, which can utilize a resist double layer with a UV-opaque interlayer, in accordance with another embodiment. In FIG. 6, a group of layers are shown including a top photoresist layer 302, a UV-opaque layer 304, a bottom photoresist layer 306, a release layer 308 (which may be optional), and a UV-transparent support plate 310. The top photoresist layer 302, the UV-opaque layer 304, the bottom photoresist layer 306, and the release layer 308 can be coated onto the UV-transparent support plate 310. The UV-opaque layer 304 preferably has a very low surface free energy. To enhance inter-layer adhesion free radicals can be generated on surfaces before applying the next layers.

Figure 7:
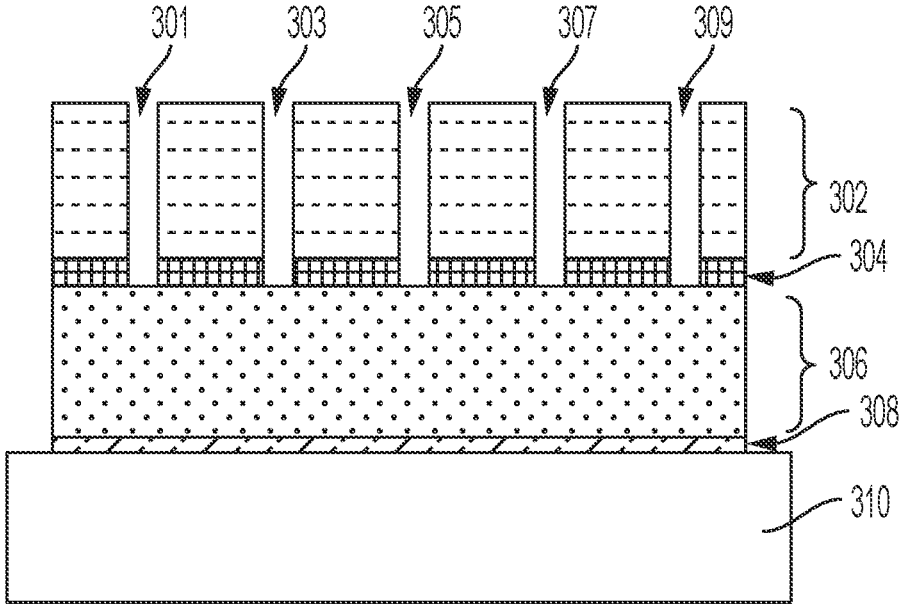
FIG. 7 illustrates a second step of a method for fabricating the array of insulated channels, in accordance with the embodiment depicted in FIG. 6.

FIG. 7 illustrates a second step of a method for fabricating an array of insulated channels such as the array 201, in accordance with the embodiment depicted in FIG. 6. The top photoresist layer 302 (e.g., a positive resist) can be exposed with a patterned mask and the resist developed. Then the UV-opaque layer 304 can be etched through with a selective etchant. The bottom photoresist layer 306 (e.g., a negative resist) can be exposed from the bottom side through the support plate 310. The lower photoresist layer 306 can be then developed via holes 301, 303, 303, 305, 307 and 309 configured in the top photoresist layer 302.

Figure 8:
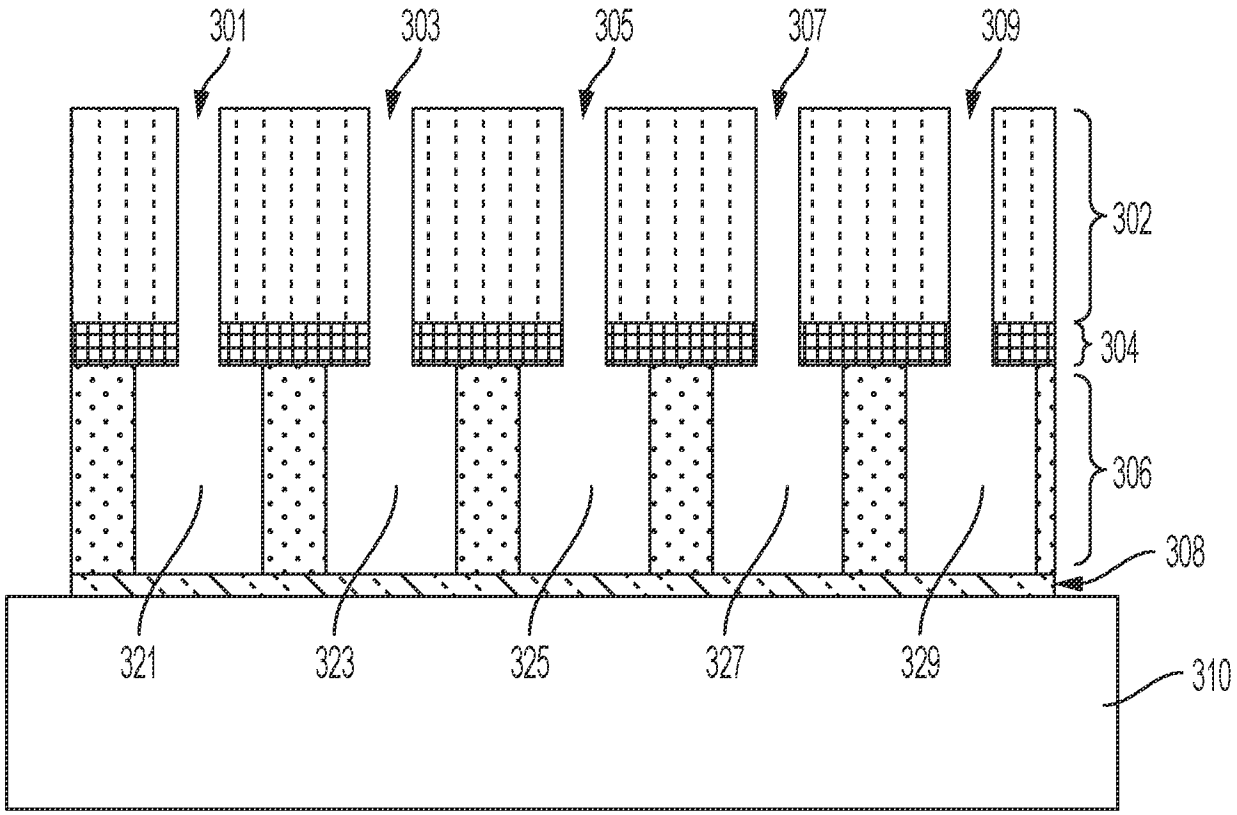
FIG. 8 illustrates a third step of a method for fabricating the array of insulated channels, in accordance with the embodiment depicted in FIG. 6 and FIG. 7.

FIG. 8 illustrates a third step of a method for fabricating an array of insulated channels such as the array 201, in accordance with the embodiment depicted in FIG. 6 and FIG. 7. In a related process the bottom side can be exposed to the aligned pattern, then released from the carrier plate and then developed. The patterned sheet can be then released from the support plate 310 and wrapped around the metal support as described above. The result can be holes (forming channels) 301, 303, 305, 307 and 309 formed in the top photoresist layer 302 and large holes (gaps or channels) 321, 323, 325, 327 and 329 configured in the lower portion or bottom photoresist layer 306.

Figure 9:
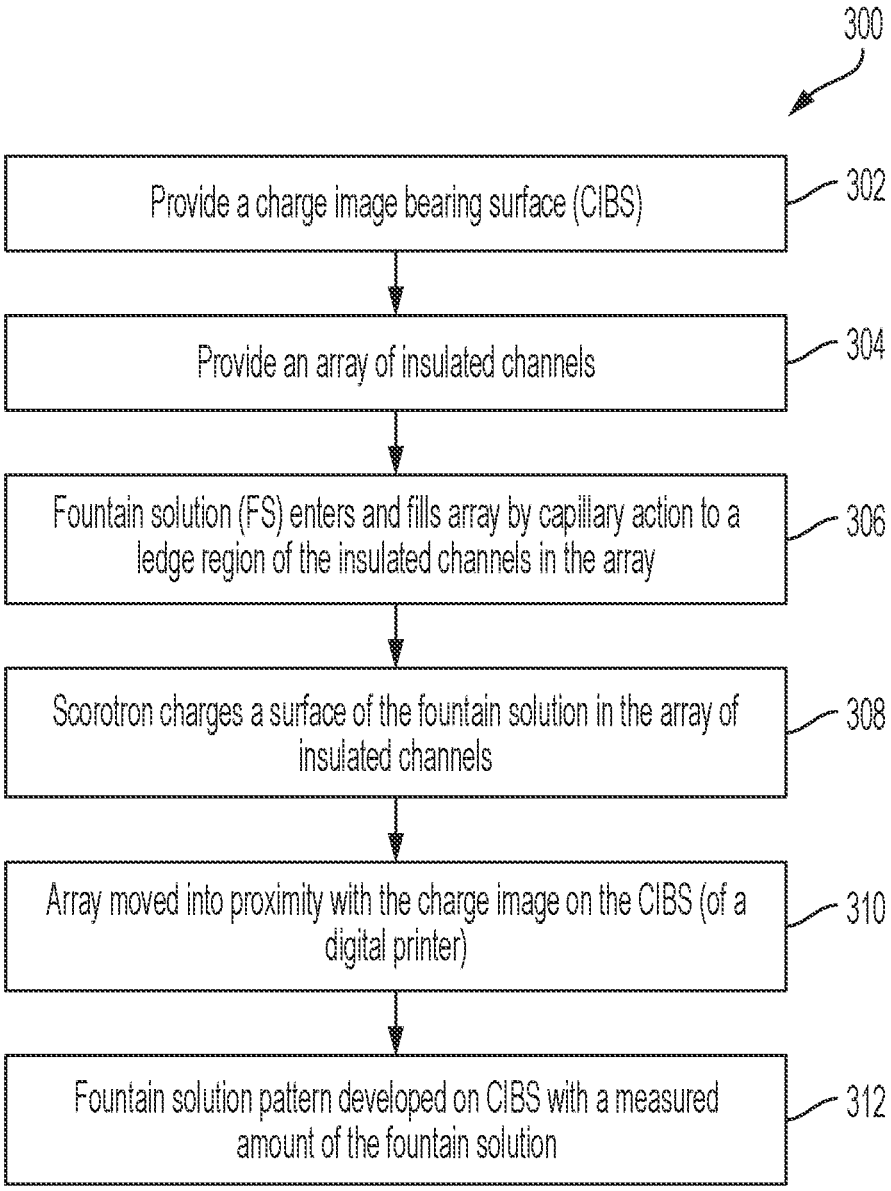
FIG. 9 illustrates a high-level flow chart of operations depicting logical operational steps of a method for creating a fountain solution pattern for digital imaging, in accordance with an embodiment.

FIG. 9 illustrates a high-level flow chart of operations depicting logical operational steps of a method 300 for creating a fountain solution pattern for digital imaging, in accordance with an embodiment. As depicted at block 302, a step or operation can be implemented to provide a CIBS (e.g., such as the CIBS 204 depicted in FIG. 4). The CIBS can bear a charge image.

Next, as shown at block 304, a step or operation can be implemented to provide an array of insulated channels (e.g., such as the array 201), such that a fountain solution can enter and fill the array 201 by capillary action to a ledge region of the insulated channels in the array 201. Thus, as depicted next at block 306, the fountain solution can enter and fill the array 201 of insulated channels by capillary action to a ledge region of insulated channels in the array 201.

Thereafter, as illustrated at block 308 a step operation can be implemented to charge, with the scorotron 220 shown in FIG. 3, a surface of the fountain solution in the array 201. Next, as shown at block 310, a step or operation can be implemented to move the array 201 into proximity with the charged image on the CIBS of a digital printer (e.g., digital printing system 100). Then, as depicted at block 312, a step or operation can be implemented to develop a fountain solution on the charge image bearing surface with a measured amount of the fountain solution. The operations shown at blocks 310 and 312 involve moving the array of insulated channels into proximity with the charge image on the charge image bearing surface of a digital printer, such that a fountain solution pattern can be developed on the charge image bearing surface with a measured amount of the fountain solution.

The techniques described herein can be applied to various types of digital printing systems such as DALI printing systems. In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Figure 10:
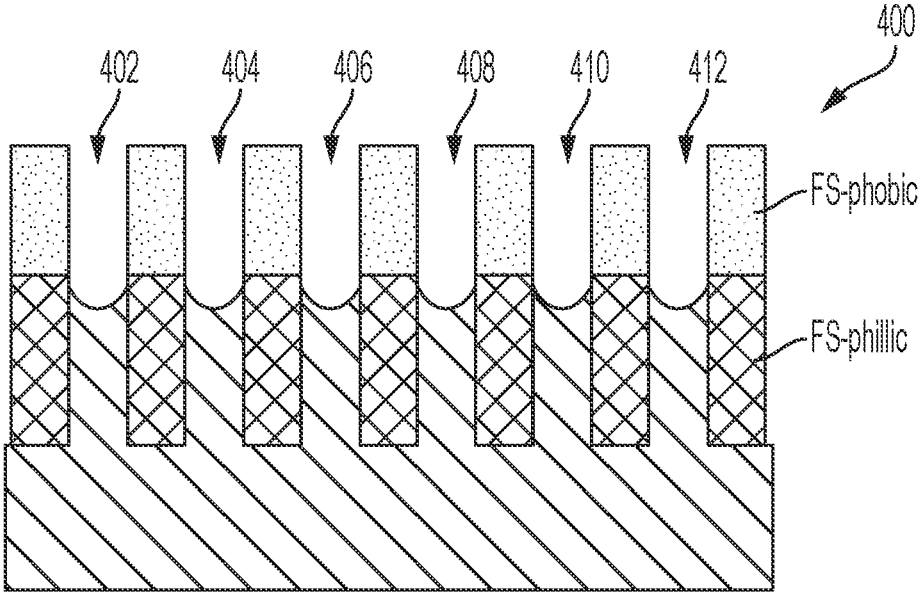
FIG. 10 illustrates a side view of an array of insulated channels, which can be implemented in accordance with an alternative embodiment.

FIG. 10 illustrates a side view of an array 400 of insulated channels 402, 404, 406, 408, 410, and 412, which can be implemented in accordance with an alternative embodiment. In lieu of the stepped diameter features discussed with respect to one or more of the other embodiments, holes can be configured and used through a bilayer configuration (i.e., 'bilayer') for the array 400 that includes fountain solution (FS)-phillic and FS-phobic materials as shown in FIG. 10.

Figure 11:
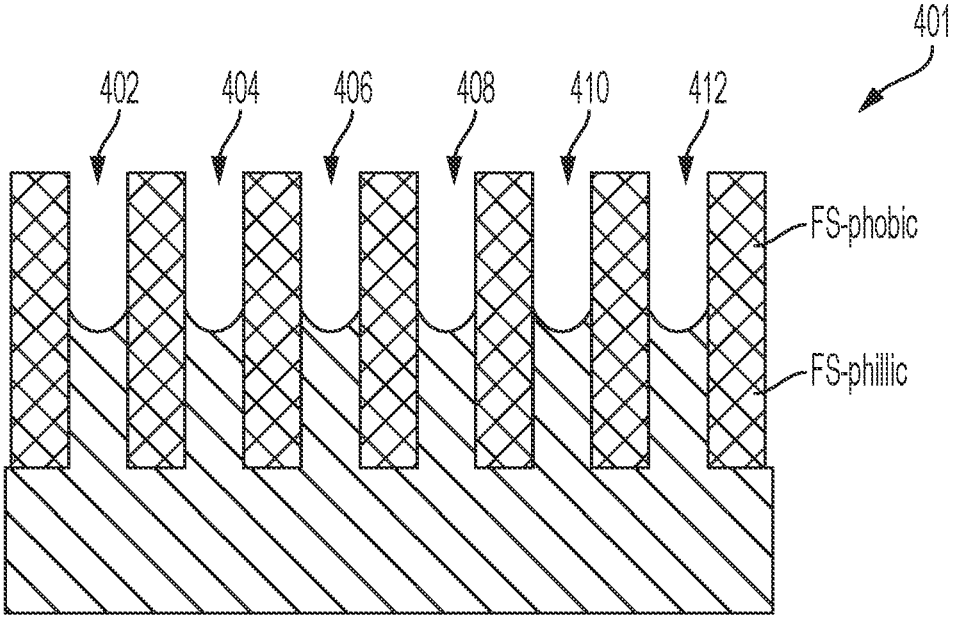
FIG. 11 illustrates a side view of an array of insulated channels, which can also be implemented in accordance with another embodiment.

FIG. 11 illustrates a side view of an array 401 of insulated channels 402, 404, 406, 408, 410, and 412, which can also be implemented in accordance with an alternative embodiment. Note that in FIG. 10 and FIG. 11 identical or similar parts are indicated by identical reference numerals. In the alternative embodiment of the array 401 shown in FIG. 11, rather than incorporating a bilayer configuration such as shown in FIG. 10, a uniform layer can be implemented with hole walls terminated in FS-phillic and FS-phobic coatings within the respective channels 402, 404, 406, 408, 410, and 412.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

It should also be noted that at least some of the operations for the methods described herein may be implemented using software instructions stored on a computer useable storage medium for execution by a computer. As an example, an embodiment of a computer program product includes a computer useable storage medium to store a computer readable program.

The computer-useable or computer-readable storage medium can be an electronic, magnetic, optical, electromagnetic, infrared, or semiconductor system (or apparatus or device). Examples of non-transitory computer-useable and computer-readable storage media include a semiconductor or solid-state memory, magnetic tape, a removable computer diskette, a random access memory (RAM), a read-only memory (ROM), a rigid magnetic disk, and an optical disk. Current examples of optical disks include a compact disk with read only memory (CD-ROM), a compact disk with read/write (CD-R/W), a digital video disk (DVD), Flash memory, and so on.

Alternatively, embodiments of the invention may be implemented entirely in hardware or in an implementation containing both hardware and software elements. In embodiments that do utilize software, the software may include but is not limited to firmware, resident software, microcode, etc.

In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Based on the foregoing, it can be appreciated that a number of embodiments including preferred and alternative embodiments, are disclosed herein. For example, in an embodiment, a system for creating a fountain solution pattern for digital imaging, can include a charge image bearing surface bearing a charge image, an array of insulated channels, wherein a fountain solution enters and fills the array of insulated channels by capillary action to a ledge region of the insulated channels in the array of insulated channels, and a scorotron that charges a surface of the fountain solution in the array of insulated channels. The array of insulated channels can be moved into proximity with the charge image on the charge image bearing surface of a digital printer, and a fountain solution pattern can be developed on the charge image bearing surface with a measured amount of the fountain solution.

In an embodiment, the fountain solution pattern developed on the charge image bearing surface can include a fountain solution image that is subsequently transferrable to a blanket.

In an embodiment, the blanket can comprise an optically absorbing blanket.

In an embodiment, the array of insulated channels can be a two-dimensional array of the insulated channels.

In an embodiment, the array of insulated channels can be an electrically insulated matrix.

In an embodiment, the array of insulated channels can be a capillary matrix.

In an embodiment, the array of insulated channels can be configured from a resist double layer with a UV-opaque interlayer.

In an embodiment, the array of insulated channels can include one or more of a bilayer comprising a plurality of holes formed through fountain solution (FS)-phillic and FS-phobic materials, or a uniform layer with hole walls terminated in FS-phillic and FS-phobic coatings.

In another embodiment, a method for creating a fountain solution pattern for digital imaging, can involve: providing an array of insulated channels and a charge image bearing surface bearing a charge image, wherein a fountain solution enters and fills the array of insulated channels by capillary action to a ledge region of insulated channels in the array of insulated channels; charging with a scorotron, a surface of the fountain solution in the array of insulated channels; moving the array of insulated channels into proximity with the charge image on the charge image bearing surface of a digital printer; and developing a fountain solution pattern on the charge image bearing surface with a measured amount of the fountain solution.

In another embodiment, a system for creating a fountain solution pattern for digital imaging, can include: at least one processor and a memory, the memory storing instructions to cause the at least one processor to perform: charging with a scorotron, a surface of a fountain solution in an array of insulated channels wherein the fountain solution enters and fills the array of insulated channels by capillary action to a ledge region of the insulated channels in the array of insulated channels; and moving the array of insulated channels into proximity with a charge image on a charge image bearing surface of a digital printer, wherein a fountain solution pattern can be developed on the charge image bearing surface with a measured amount of the fountain solution.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A system for creating a fountain solution pattern for digital imaging, comprising:

a charge image bearing surface bearing a charge image;

an array of insulated channels, wherein a fountain solution enters and fills the array of insulated channels by capillary action to a ledge region of the insulated channels in the array of insulated channels;

a scorotron that charges a surface of the fountain solution in the array of insulated channels; and wherein the array of insulated channels is moved into proximity with the charge image on the charge image bearing surface of a digital printer, wherein a fountain solution pattern is developed on the charge image bearing surface with a measured amount of the fountain solution.

2. The system of claim 1 wherein the fountain solution pattern developed on the charge image bearing surface comprises a fountain solution image that is subsequently transferrable to a blanket.

3. The system of claim 2 wherein the blanket comprises an optically absorbing blanket.

4. The system of claim 1 wherein the array of insulated channels comprises a two-dimensional array of the insulated channels.

5. The system of claim 1 wherein the array of insulated channels comprises an electrically insulated matrix.

6. The system of claim 1 wherein the array of insulated channels comprises a capillary matrix.

7. The system of claim 1 wherein the array of insulated channels is configured from at least a resist double layer with a UV-opaque interlayer.

8. The system of claim 1 wherein the array of insulated channels comprises at least one of:

a bilayer comprising a plurality of holes formed through fountain solution (FS)-phillic and FS-phobic materials; or a uniform layer with hole walls terminated in FS-phillic and FS-phobic coatings.

9. A method for creating a fountain solution pattern for digital imaging, comprising:

providing an array of insulated channels and a charge image bearing surface bearing a charge image, wherein a fountain solution enters and fills the array of insulated channels by capillary action to a ledge region of insulated channels in the array of insulated channels;

charging with a scorotron, a surface of the fountain solution in the array of insulated channels;

moving the array of insulated channels into proximity with the charge image on the charge image bearing surface of a digital printer; and developing a fountain solution pattern on the charge image bearing surface with a measured amount of the fountain solution.

10. The method of claim 9 wherein the fountain solution pattern developed on the charge image bearing surface comprises a fountain solution image that is subsequently transferrable to a blanket.

11. The method of claim 10 wherein the blanket comprises an optically absorbing blanket.

12. The method of claim 9 wherein the array of insulated channels comprises a two-dimensional array of the insulated channels.

13. The method of claim 9 wherein the array of insulated channels comprises an electrically insulated matrix.

14. The method of claim 9 wherein the array of insulated channels comprises a capillary matrix.

15. The method of claim 9 wherein the array of insulated channels is configured from at least a resist double layer with a UV-opaque interlayer.

16. The method of claim 9 wherein the array of insulated channels comprises at least one of:

a bilayer comprising a plurality of holes formed through fountain solution (FS)-phillic and FS-phobic materials; or a uniform layer with hole walls terminated in FS-phillic and FS-phobic coatings.

17. A system for creating a fountain solution pattern for digital imaging, comprising:

at least one processor and a memory, the memory storing instructions to cause the at least one processor to perform:

charging with a scorotron, a surface of a fountain solution in an array of insulated channels wherein the fountain solution enters and fills the array of insulated channels by capillary action to a ledge region of the insulated channels in the array of insulated channels; and moving the array of insulated channels into proximity with a charge image on a charge image bearing surface of a digital printer, wherein a fountain solution pattern is developed on the charge image bearing surface with a measured amount of the fountain solution.

18. The system of claim 17 wherein the fountain solution pattern developed on the charge image bearing surface comprises a fountain solution image that is subsequently transferrable to a blanket.

19. The system of claim 17 wherein the array of insulated channels comprises at least one of: a two-dimensional array of the insulated channels, an electrically insulated matrix, or a capillary matrix.

20. The system of claim 17 wherein the array of insulated channels comprises at least one of:

a bilayer comprising a plurality of holes formed through fountain solution (FS)-phillic and FS-phobic materials; or a uniform layer with hole walls terminated in FS-phillic and FS-phobic coatings.

* * * * *